United States Patent [19]

Kino

[11] Patent Number: 4,864,908

[45] Date of Patent: Sep. 12, 1989

[54] SYSTEM FOR SELECTING ACCOMPANIMENT PATTERNS IN AN ELECTRONIC MUSICAL INSTRUMENT

[75] Inventor: Masayoshi Kino, Hamamatsu, Japan

[73] Assignee: Yamaha Corporation, Hamamatsu, Japan

[21] Appl. No.: 34,479

[22] Filed: Apr. 2, 1987

[30] Foreign Application Priority Data

Apr. 7, 1986 [JP] Japan ..... 61-79448

[51] Int. Cl.[4] ..... G10F 1/00; G10H 1/26; G10H 1/42

[52] U.S. Cl. ..... 84/638; 84/478; 84/DIG. 12

[58] Field of Search ..... 84/1.03, DIG. 12, 1.19, 84/1.11, 477 R, 478

[56] References Cited

U.S. PATENT DOCUMENTS

| | | | |
|---|---|---|---|
| 4,185,531 | 1/1980 | Oberheim et al. | 84/1.11 |
| 4,344,345 | 8/1982 | Sano | 84/1.03 |
| 4,356,751 | 11/1982 | Niinomi et al. | 84/1.03 |
| 4,538,495 | 9/1985 | Sato | 84/1.19 |
| 4,539,882 | 9/1985 | Yuzawa | 84/1.03 |
| 4,672,876 | 6/1987 | Sugiyama et al. | 84/1.03 |

*Primary Examiner*—Arthur T. Grimley
*Assistant Examiner*—John G. Smith
*Attorney, Agent, or Firm*—Spensley Horn Jubas & Lubitz

[57] ABSTRACT

A system for selecting accompaniment patterns in accordance with which accompaniment musical tones are produced in an electronic musical instrument. The system includes a memory for storing a plurality of accompaniment patterns. A plurality of storage devices corresponding respectively to a plurality of operable members is provided. A select device is operable to select one of the accompaniment patterns to produce pattern identification data indicative of the selected accompaniment pattern. A writing device is responsive to an operation of any one of the operable members for writing the pattern identification data into one of the storage devices corresponding to the operated one operable member, thereby assigning the selected accompaniment pattern to the one operable member. A reading device is responsive to an operation of the one operable member for reading from the memory the selected accompaniment pattern.

6 Claims, 9 Drawing Sheets

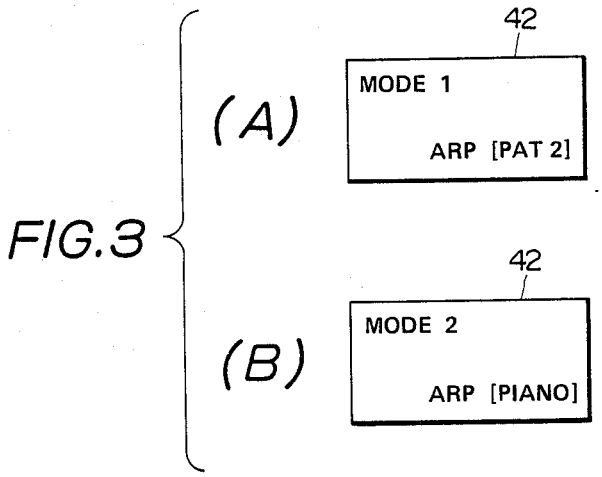
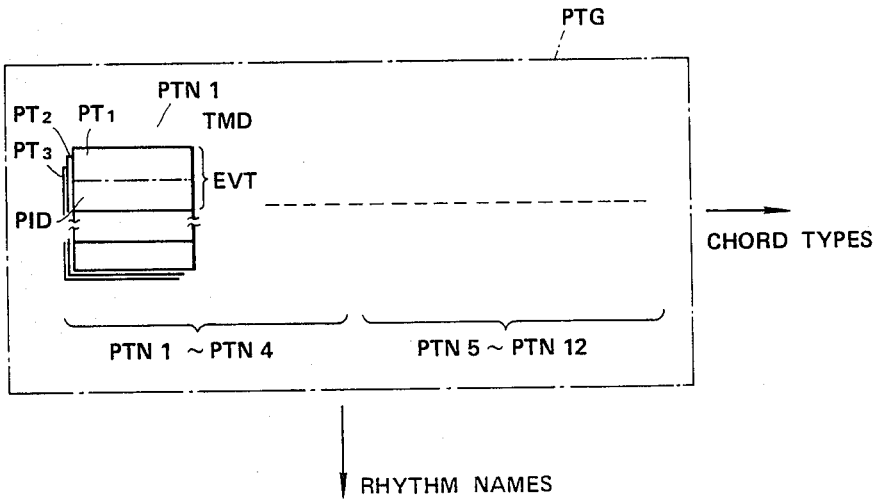
FIG.4

FIG.5
(A)
PTN 1
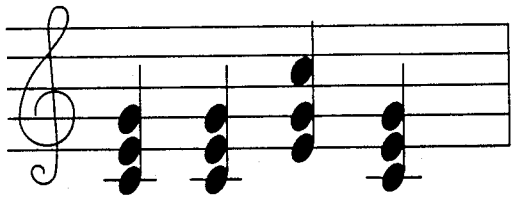
(B)
PTN 5 (PAT 1)
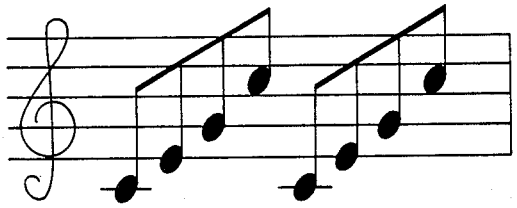
(C)
PTN 6 (PAT 2)
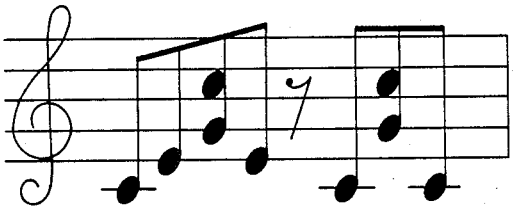

SYSTEM FOR SELECTING ACCOMPANIMENT PATTERNS IN AN ELECTRONIC MUSICAL INSTRUMENT

BACKGROUND OF THE INVENTION

1. Field of the Invention

This invention relates generally to an automatic accompaniment device for an electronic musical instrument, such as an auto-arpeggio device and particularly to an accompaniment pattern-selecting system for use in such an automatic accompaniment device.

2. Prior Art

In conventional automatic accompaniment devices such as an auto-arpeggio device, operable members such as switches are fixedly assigned respective accompaniment patterns and tone colors. More specifically, when a certain operable member is operated, the accompaniment pattern and tone color (for example, tone color of a piano) corresponding to the operated member are selected, so that the automatic accompaniment is performed in the selected pattern and tone color.

Generally, the conventional automatic accompaniment device of the type described only has such selectable accompaniment patterns and tone colors corresponding in number to the operable members, and therefore there have been occasions when the player of the electronic musical instrument selects such accompaniment pattern and tone color that are not well suited for the music the player is going to play.

It can be considered that the number of the operable members is increased so that the accompaniment patterns and tone colors have a wider variety. However, this is undesirable since the increased number of the operable members consume more space, which increases the overall size of the musical instrument, and besides the operation of selecting of the operable members becomes cumbersome.

SUMMARY OF THE INVENTION

It is therefore an object of this invention to provide an accompaniment pattern-selecting system which easily enables the selection of a accompaniment pattern and tone color suited for the music to be performed, without unduly increasing the number of operable members.

According to the present invention, there is provided a system for selecting accompaniment patterns in accordance with which accompaniment musical tones are produced in an electronic musical instrument, the system comprising (a) a memory for storing a plurality of accompaniment patterns; (b) a plurality of operable members; (c) a plurality of storage means corresponding to the operable members, respectively; (d) select means for selecting one of the accompaniment patterns to produce pattern identification data indicative of the selected accompaniment pattern; (e) writing means responsive to an operation of any one of the operable members for writing the pattern identification data into one of the storage means corresponding to the operated one operable member, thereby assigning the selected accompaniment pattern to the one operable member; and (f) reading means responsive to an operation of the one operable member for reading from the memory the selected accompaniment pattern.

With the system according to the present invention, each of the operable members such as switches can be assigned any one of the accompaniment patterns, and this assignment can be changed. Therefore, with a relatively limited number of the operable members, a wider variety of accompaniment patterns can be selected when playing a music.

According to another aspect of the present invention, the select means may also be operable to select one of tone colors stored in a tone color memory and corresponding to the pattern identification data. The reading means is also responsive to an operation of the one operable member for reading from the tone color memory the selected tone color. With this arrangement, when playing a music, the accompaniment pattern and the tone color can be assigned in pair to the operable member. As another alternative, the accompaniment pattern and the tone color can be assigned to the operable members independently of each other.

BRIEF DESCRIPTION OF THE DRAWINGS

FIGS. 3(A) and 3(B) are schematic views of a menu display unit;

FIG. 4 is a diagrammatical illustration showing the contents of a pattern memory;

FIGS. 5(A) to 5(C) are are illustrations showing examples of arpeggio chord patterns;

DESCRIPTION OF THE PREFERRED EMBODIMENTS OF THE INVENTION

Figure 1:
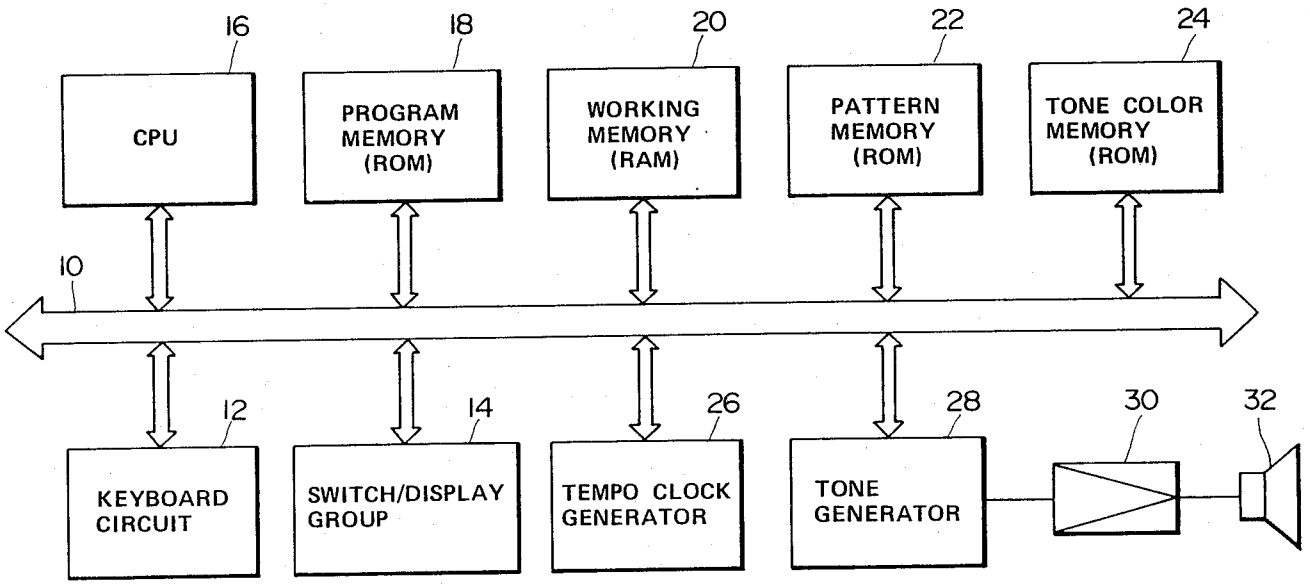
FIG. 1 is a block diagram of the circuitry of the electronic musical instrument incorporating the automatic accompaniment system according to the present invention.

FIG. 1 shows a block diagram of a circuitry of an electronic musical instrument incorporating an automatic accompaniment device according to one embodiment of the present invention. In the electronic musical instrument, the assignment of the accompaniment patterns and tone colors to the operable members or switches, the production of the various musical tones and the other operations are carried out under the control of a microcomputer.

Construction of Circuity (FIG. 1)

A keyboard circuit 12, a switch/display group 14, a central processing unit 16 (CPU), a program memory 18, a working memory 20, a pattern memory 22, a tone memory 24, a tempo clock generator 26 and a tone generator (TG) 28 are connected to a bus 10. A keyboard unit comprises a first key zone for producing a melody and a second key zone for producing an accompaniment, the keyboard unit being of either a single-keyboard type or a double-keyboard type. The keyboard unit is electrically connected to the keyboard circuit 12, and the key-operation information of each key (key-on/key-off) is detected by the keyboard circuit 12.

The switch/display group 14 comprises various switches mounted on a control panel for controlling the musical tones, and display units related to those switches. Those switches and display unit concerned with the present invention will be described later with reference to FIG. 2.

In accordance with a program stored in the program memory 18 consisting of a read only memory (ROM), the CPU 16 executes the various processings such as the assignment of the accompaniment patterns and tone colors to the switches and the production of the musical tones. Such processings will be described later with reference to FIGS. 6 to 10.

The working memory 20 consists of a random access memory (RAM) and contains memory areas which serve as registers and counters when the various processings are performed under the control of the microcomputer, as later described.

The pattern memory 22 consists of a ROM storing a number of arpeggio chord patterns. The contents of the memory 22 will be described later with reference to FIG. 4.

The tone color memory 24 consists of a ROM storing tone color control data representative respectively of tone colors of a piano, a harpsichord, a brass and so on.

The tempo clock generator 26 produces tempo clock pulses in accordance with a selected tempo. The tempo clock pulse serves as an interrupt command signal for initiating an interrupt routine of FIG. 10.

The tone generator (TG) 28 generates melody tone signals in accordance with the operation of the keys of the keyboard unit and also generates arpeggio chord tone signals in accordance with the data read from the pattern memory 22. The tone generator 28 has three channels for the arpeggio chord tone signals. The musical tone signals generated from the tone generator 28 are fed to a speaker 32 via an output amplifier 30 so as to produce acoustic sound.

Figure 2:
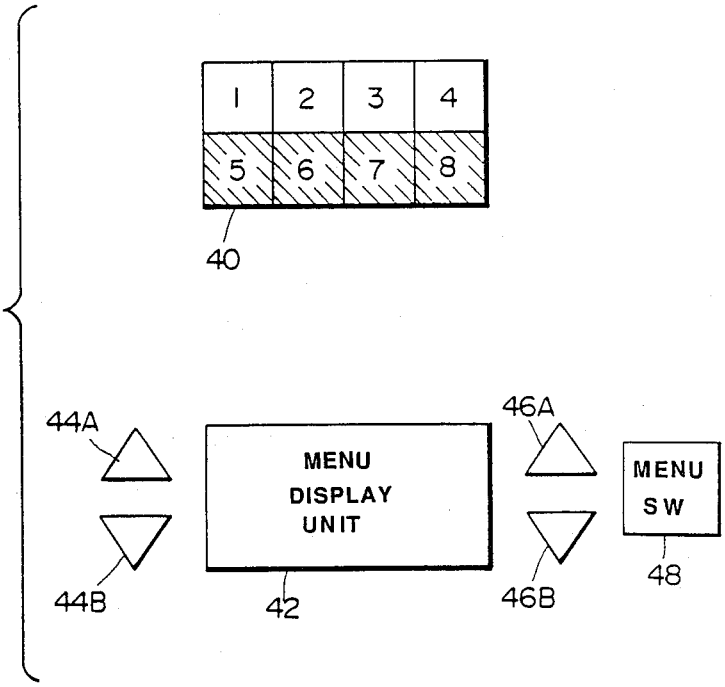
FIG. 2 is a schematic view showing an arrangement of the switches and display unit on a control panel.

Arrangement of Switches and Display on Control Panel (FIG. 2)

FIG. 2 shows an arrangement of the switches and display unit on the control panel. A switch group 40 comprises eight arpeggio chord select switches SW1 to SW8. Each of the switches SW1 to SW4 is fixedly assigned a predetermined arpeggio chord pattern and a predetermined tone color while a desired arpeggio chord pattern and a desired tone color can arbitrarily be assigned to each of the switches SW5 to SW8.

A menu display unit 42 is in the form, for example, of a liquid crystal display device. A pair of mode switches 44A and 44B for selecting the modes of operation are arranged on the left side of the menu display unit 42 (FIG. 2). A pair of select switches 46A and 46B and a menu switch 48 are arranged on the right side of the menu display unit 42.

When the menu switch 48 is turned on, a menu of the mode selected by the mode switch 44A or 44B is displayed on the menu display unit 42. The contents of the menu can be changed by the select switch 46A or 46B. "Mode 1" is a mode for selecting the arpeggio chord patterns. For example, when "mode 1" is selected, the menu is displayed as shown in FIG. 3(A). In this case, the selected mode and the selected arpeggio chord pattern, for example, "arpeggio chord pattern 2", are displayed respectively a "mode 1" and "ARP[PAT2]" on the menu display unit 42.

"Mode 2" is a mode for selecting the tone colors of the arpeggio chord. For example, when "mode 2" is selected, the menu is displayed as shown in FIG. 3(B). In this case, the selected mode and the selected tone color, for example, a piano tone, are displayed as "mode 2" and "ARP[PIANO]" on the menu display unit 42.

Contents of Pattern Memory (FIG. 4)

FIG. 4 shows the contents of the pattern memory 22. A plurality of pattern groups PTG are stored in the pattern memory 22. The number of the pattern groups PTG is equal to the number of (the rhythm names x the chord types), so that each pattern group PTG is determined by a respective one of of the chord types and a respective one of the rhythm names.

For example, each pattern group PTG comprises twelve (12) arpeggio chord patterns PTN 1 to PTN 12. The arpeggio chord patterns PTN1 to PTN4 are fixedly assigned to the arpeggio chord select switches SW1 to SW4, respectively, and each of the arpeggio chord patterns PTN5 to PTN12 can be arbitrarily assigned to any one of the arpeggio chord select switches SW5 to SW8.

The data formats of the arpeggio chord patterns PTN1 to PTN12 are the same, and therefore only the pattern PTN1 will now be described. The pattern PTN1 is composed of three pattern data PT1 to PT3 for the three channels. Each pattern data is composed of sequentially-arranged event data EVT and a end code at the end thereof. Event data is composed, for example, of two bytes, and the 1st byte constitutes timing data TMD while the 2nd byte constitutes pitch data PID. The value of the timing data TMD, corresponding to the count of the tempo clock pulses, represents the timing at which the musical tone is either produced or stopped. The pitch difference data PID represents the pitch difference or degree in half tones, with respect to the root note of the musical tone to be either produced or stopped. Since the pattern PTN1 is composed of pattern data PT1 to PT3 for the three channels, up to three musical tones can be simultaneously produced at a time, that is, at one timing.

FIGS. 5(A) to (C) show arpeggio chord patterns stored in the pattern memory 22. FIG. 5(A) show the contents of pattern PTN1, and FIG. 5(B) shows the contents of pattern PTN5 (pattern name "PAT1"), and FIG. 5(C) shows the contents of pattern PTN6 (pattern name "PAT2"). The pattern PTN1 represents a predetermined tone color, for example, a tone color of a piano.

Registers of the Working Memory

Those registers of the working memory 20 related to the present invention will now be described.

(1) Mode Counter MODE

The count of this counter is incremented by one each time the mode switch 44A is turned on, and the count is decremented by one each time the mode switch 44B is turned on. The count of the mode counter MODE represents the mode of operation.

(2) Select Counter SLCNT

The count of this counter is incremented by one each time the select switch 46A is turned on, and the count is decremented by one each time the select switch 46B is turned on. In accordance with the count of the select counter SLCNT, the name of the pattern and the name of the tone color are displayed on the menu display unit 42.

(3) Arpeggio Chord Number Register ARPNO

Any one of the arpeggio chord numbers 1 to 8 corresponding to the turned-on switch among the group 40 of the arpeggio chord select switches SW1 to SW8 is stored in this register.

(4) Pattern Number Registers PTNREG5 to PTNREG8

These registers PTNREG5 to PTNREG8 correspond to the arpeggio chord select switches SW5 to SW8, respectively, and the pattern number is adapted to be stored in each of these registers.

(5) Tone Color Number Registers VCNREG5 – VCNREG8

These registers VCNREG5 to VCNREG8 correspond to the arpeggio chord select switches SW5 to SW8, respectively, and the tone color number is adapted to be stored in each of these registers.

(6) Tempo Counter TCL

The count of this counter is incremented by one each time a tempo clock pulse is generated from the tempo clock generator 26. The count of the tempo counter TCL varies from 0 to 63 within one bar or measure, and the contents of the counter is cleared to zero at the end of each bar or measure, that is, at the timing of 64.

Figure 6:
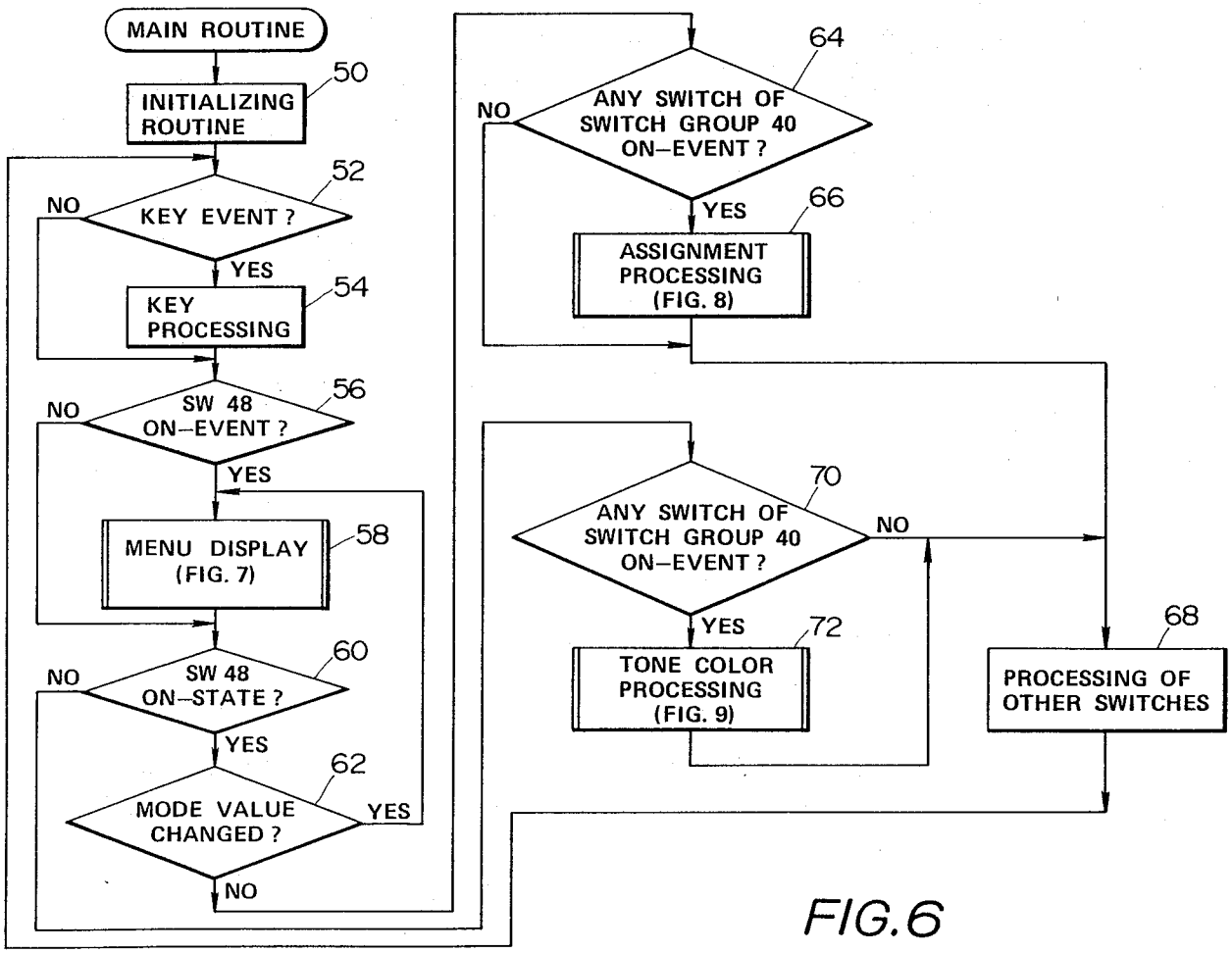
FIG. 6 is a flow chart of a main routine.

Main Routine (FIG. 6)

FIG. 6 shows a flow chart of the main routine.

First, in Step 50, an initializing routine is executed to initialize the registers and so on. For example, the counters MODE, SLCNT and TCL are cleared to zero.

Next, in step 52, in accordance with the key operation information from the keyboard circuit 12, it is determined whether there is any key event (i.e., any key on the keyboard has been depressed (key-on) or any depressed key has been released (key-off)). If the result is "YES", the processing proceeds to Step 54 in which the key processing is carried out. In this case, if the key-on of one key on the keyboard is detected, the tone generator TG is controlled by the microcomputer to produce a musical tone corresponding to this depressed-key. On the other hand, if the key-off of one key is detected, the tone generator TG is controlled to stop the production of the musical tone corresponding to that key. Also, if the key-on is detected in the accompaniment key zone, the chord type and root are detected in accordance with the state or condition of depression of the key.

Then, the processing proceeds to Step 56 from Step 54. If the result of Step 52 is "NO", the processing jumps over Step 54 to Step 56. In Step 56, it is determined whether there is "on-event" of the menu switch 48 (i.e., the switch 48 has been turned on). If the result of this Step is "YES", the processing proceeds to Step 58 in which a subroutine of the menu display is executed as later described with reference to FIG. 7. Then, the processing proceeds to Step 60. If the result of Step 56 is "NO", the processing jumps over Step 58 to Step 60.

In Step 60, it is determined whether the menu switch is in the on-state (i.e., the menu is being displayed). If the result of this Step is "YES", the processing proceeds to Step 62 in which it is determined whether the count or value of the mode counter MODE is varied (i.e., the mode is varied). If the result of Step 62 is "YES", the processing returns to Step 58 so as to change the menu display. On the other hand, if the result of Step 62 is "NO", the processing proceeds to Step 64.

In Step 64, it is determined whether there is "on-event" of any switch among the group 40 of arpeggio chord switches SW1 to SW8 (i.e., the switch SW has been turned on). If the result is "YES", the processing proceeds to Step 66 in which a subroutine of the assignment processing with respect to the on-event switch is executed as later described with reference to FIG. 8. Then, the processing proceeds to Step 66. If the result of Step 64 is "NO", the processing jumps over Step 66 to Step 68.

If the result of Step 60 is "NO" (i.e., the menu display is not being made), the processing proceeds to Step 70 in which it is determined whether there is "on-event" of any switch among the group 40 of switches SW1 to SW8. If the result of Step 70 is "NO", the processing proceeds to Step 72 in which a subroutine of the tone color processing is executed as later described with reference to FIG. 9. Then, the processing proceeds to Step 68 in which the processing is carried out with respect to other switches. If the result of Step 70 is "NO", the processing skips over Step 72 to Step 68. After Step 68, the processing returns to Step 52, and the above procedure is repeated.

Figure 7:
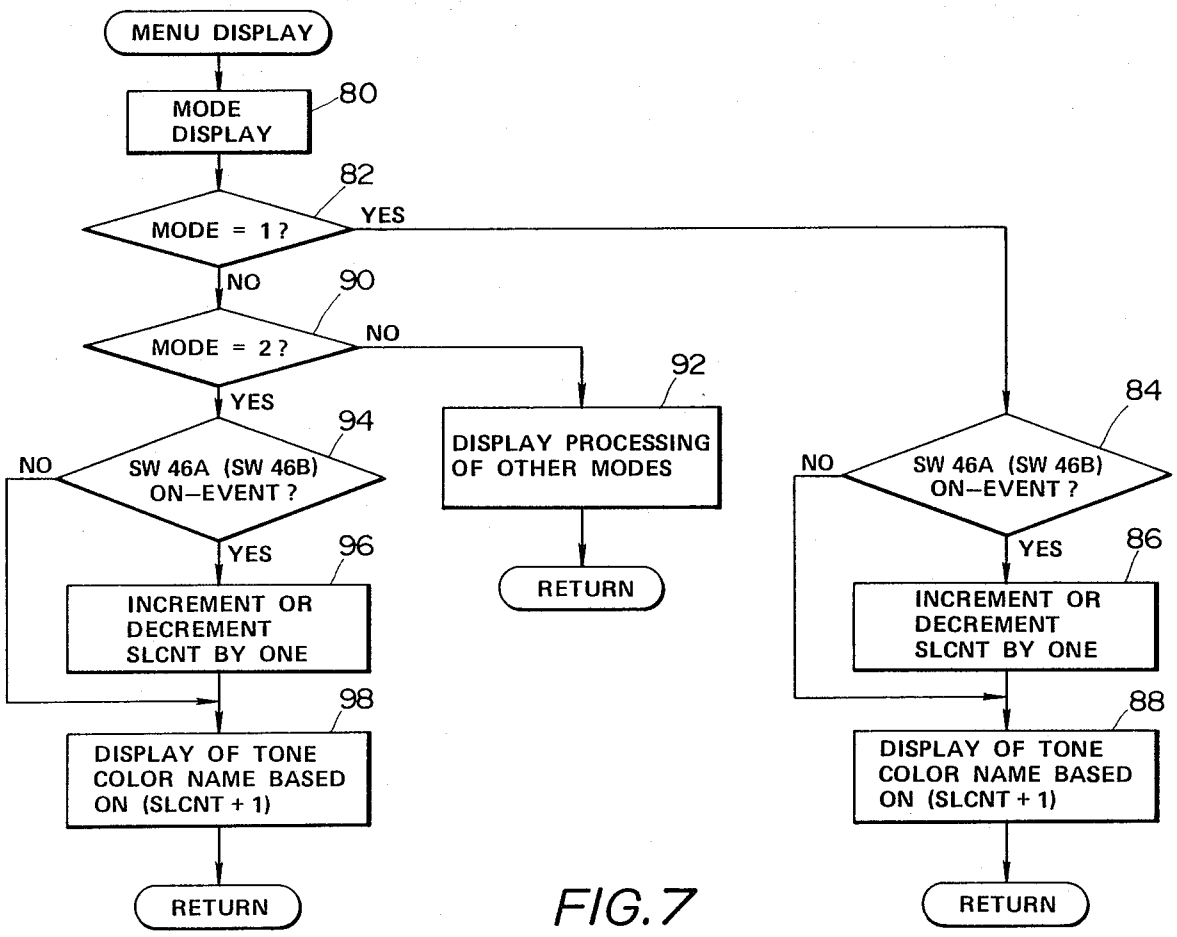
FIG. 7 is a flow chart of a subroutine of menu display.

Subroutine of Menu Display (FIG. 7)

The subroutine of the menu display will now be described with reference to FIG. 7. In Step 80, the mode represented by the count or value of the mode counter MODE is displayed on the menu display unit 42. Then, the processing proceeds to Step 82 in which it is determined whether the value of the mode is "1". If the result of this Step is "YES", the processing proceeds to Step 84 in which it is determined whether there is "on-event" of the select switch 46A or 46B (i.e., the switch has been turned on). If the result is "YES", the processing proceeds to Step 86. In Step 86, if the on-event switch is the switch 46A, the count or value of the select counter SLCNT is incremented one whereas if the on-event switch is the switch 46B, the count of the select counter SLCNT is decremented one. Thereafter, the processing proceeds to Step 88. If the result of Step 84 is "NO", the processing jumps over Step 86 to Step 88.

In Step 88, value "5" is added to the contents of the select counter SLCNT so as to determine the pattern number (any one of 5 to 12), and that of the pattern names "PAT1" to "PAT8" corresponding to the determined pattern number is displayed on the menu display unit 42. For example, if the count of the select counter SLCNT is "1", then the pattern number is "6", and this is displayed on the menu display unit 42 as shown in FIG. 3(A). After Step 88 of this subroutine, the processing returns to the main routine of FIG. 6.

If the result of Step 82 is "NO" (i.e., the value of the mode is not "1"), the processing proceeds to Step 90 in which it is determined whether the value of the mode is "2". If the result of this Step is "NO", this means that the mode is other than mode 1 and mode 2 (for example, a tempo-setting mode), and the processing proceeds to Step 92 in which the mode display processing of the other modes is carried out. Thereafter, the processing returns from this subroutine to the main routine of FIG. 6.

If the result of Step 90 is "YES" (i.e., the mode value is "2"), the processing proceeds to Step 94 in which it is determined whether there is "on-event" of the select switch 46A or 46B. If the result is "YES", the processing proceeds to Step 96 in which the count of the select counter SLCNT is either incremented or decremented one depending on the turned-on select switch, as described above for Step 86. Then, the processing proceeds to Step 98. If the result of Step 94 is "NO", the processing jumps over Step 96 to Step 98.

In Step 98, value "1" is added to the contents of the select counter SLCNT so as to determine the tone color number, and the one of the tone color names corresponding to the determined tone color number is displayed in the menu display unit 42. For example, ten (10) tone color numbers 1 to 10 are provided and correspond respectively to ten (10) tone color control data stored in the tone color memory 24. And, the tone color number 1 represents a piano tone, number 2 a harpsichord tone, number 3 a brass tone and so on. For example, if the value of the select counter SLCNT is "0", then the tone color number is 1. This is shown in FIG. 3(B). After Step 98, the processing returns to the main routine of FIG. 6.

Figure 8:
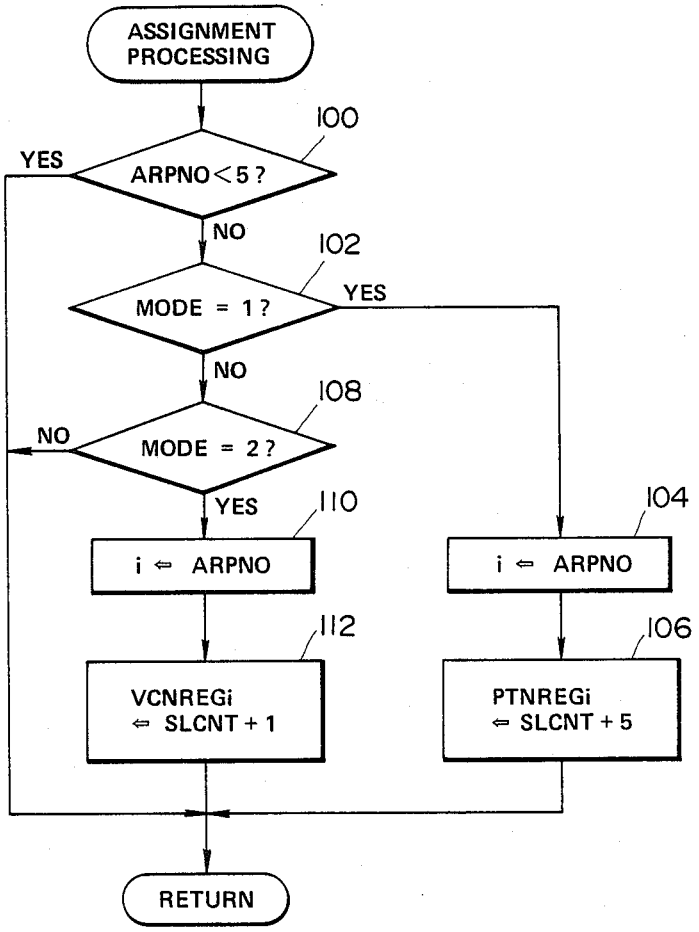
FIG. 8 is a flow chart of a subroutine of assignment processing.

Subroutine of Assignment Processing (FIG. 8)

The subroutine of the assignment processing will now be described with reference to FIG. 8. In Step 100, it is determined whether the value of the arpeggio chord number register ARPNO is less than "5" (i.e., the turned-on switch SW is the fixedly-assigned one). If the result is "YES", the processing returns to the main routine of FIG. 6. On the other hand, if the result is "NO", this means that one of the assignable switches SW5 to SW8 has been turned on.

Then, the processing proceeds to Step 102 in which it is determined whether the value of the mode counter MODE is "1"(mode 1). If the result is "YES", the processing proceeds to Step 104 in which a control variable i is made equal to the value of the arpeggio chord number register ARPNO which corresponds to the turned-on switch (i.e., one of the switches 5 to 8) to 8.

Then, in Step 106, "5" is added to the contents of the select counter SLCNT so as to determine the pattern number corresponding to the pattern name displayed in the menu display unit 42, and this pattern number is loaded into the one (PTNREGi) of the pattern number registers PTNREG5 to PTNREG8 corresponding to the variable i. In this manner, the turned-on switch is assigned the arpeggio chord pattern which is being displayed or selected. After Step 106, the processing returns to the main routine of FIG. 6.

If the result of Step 102 is "NO", the processing proceeds to Step 108 in which it is determined whether the value of the mode is "2". If the result is "NO", which means that the mode is other than mode 1 and mode 2, the processing returns to the main routine of FIG. 6. If the result of Step 108 is "YES", the processing proceeds to Step 110 in which a control variable i is made equal to the value of the arpeggio chord number register ARPNO which corresponds to the turned-on switch (i.e., one of the switches SW5 to SW8).

Then, in Step 112, "1" is added to the contents of the select counter SLCNT so as to determine the tone color number corresponding to the tone number name which is being displayed or selected, and this tone color number is loaded into the one (VCNREGi) of the tone color number registers VCNREG5 to VCNREG8 corresponding to the variable i. In this manner, the turned-on switch is assigned the tone color of the arpeggio chord which is being displayed or selected. After Step 112, the processing returns to the main routine of FIG. 6.

According to the processings of FIGS. 7 and 8, any one of the arpeggio chord patterns or the arpeggio chord tone colors is arbitrarily displayed on the menu display unit, and any one of the arpeggio chord select switches SW5 to SW8 is turned on so that the displayed pattern or tone color is assigned to the turned-on arpeggio chord select switch SW.

Figure 9:
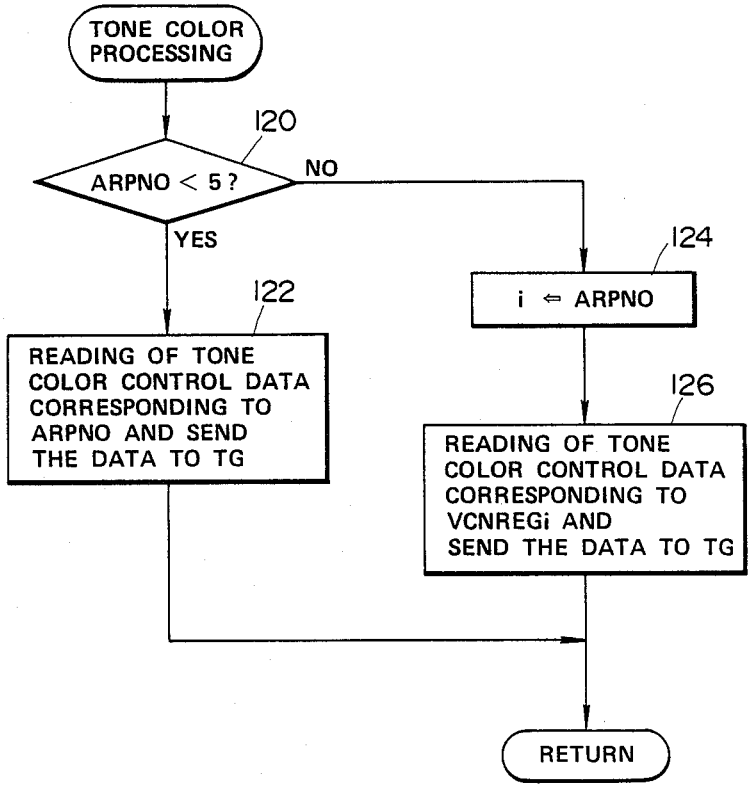
FIG. 9 is a flow chart of a subroutine of tone color processing.

Subroutine of Tone Color Processing (FIG. 9)

The subroutine of the tone color processing will now be described. In Step 120, it is determined whether the value of the arpeggio chord number register ARPNO is less than 5 (that is, the turned-on switch SW is the fixedly assigned one). If the result is "YES", the processing proceeds to Step 122 in which the tone color control data, corresponding to the value of the register ARPNO corresponding to the turned-on switch (SW1–SW4), is read from the tone color memory 24 and is fed to the tone generator (TG) 28. For example, if the arpeggio chord select switch SW1 is turned on, the tone color number stored in the register ARPNO is "1", and therefore the tone color control data representative of a piano tone is sent to the tone generator 28. Therefore, the tone generator 28 enables the production of the selected arpeggio chord tone in a piano tone. After Step 122, the processing proceeds to the main routine of FIG. 6.

If the result of Step 120 is "NO", this means that one of the assignable arpeggio chord select switches SW5 to SW8 is turned on, and, the processing proceeds to Step 124. In Step 124, a control variable i is made equal to the value of the arpeggio chord number register ARPNO which corresponds to the turned-on one of the assignable chord select switches SW5 to SW8. Then, the processing proceeds to Step 126 in which the tone color control data, corresponding to the value of the one (VCNREGi)of the tone color number registers VCNREG5 to VCNREG8 which corresponds to the variable i, is read from the tone color memory 24 and is fed to the tone generator (TG) 28. Assuming that the arpeggio chord select switch SW8 is turned on and that the tone number 10 is loaded into the register VCNREG8, the tone color data corresponding to the tone color number 10 is fed from the tone color memory 24 to the tone generator 28, so that the arpeggio chord tone is produced in a tone color corresponding to the tone color number 10. After Step 126, the processing returns to the main routine of FIG. 6.

Figure 10:
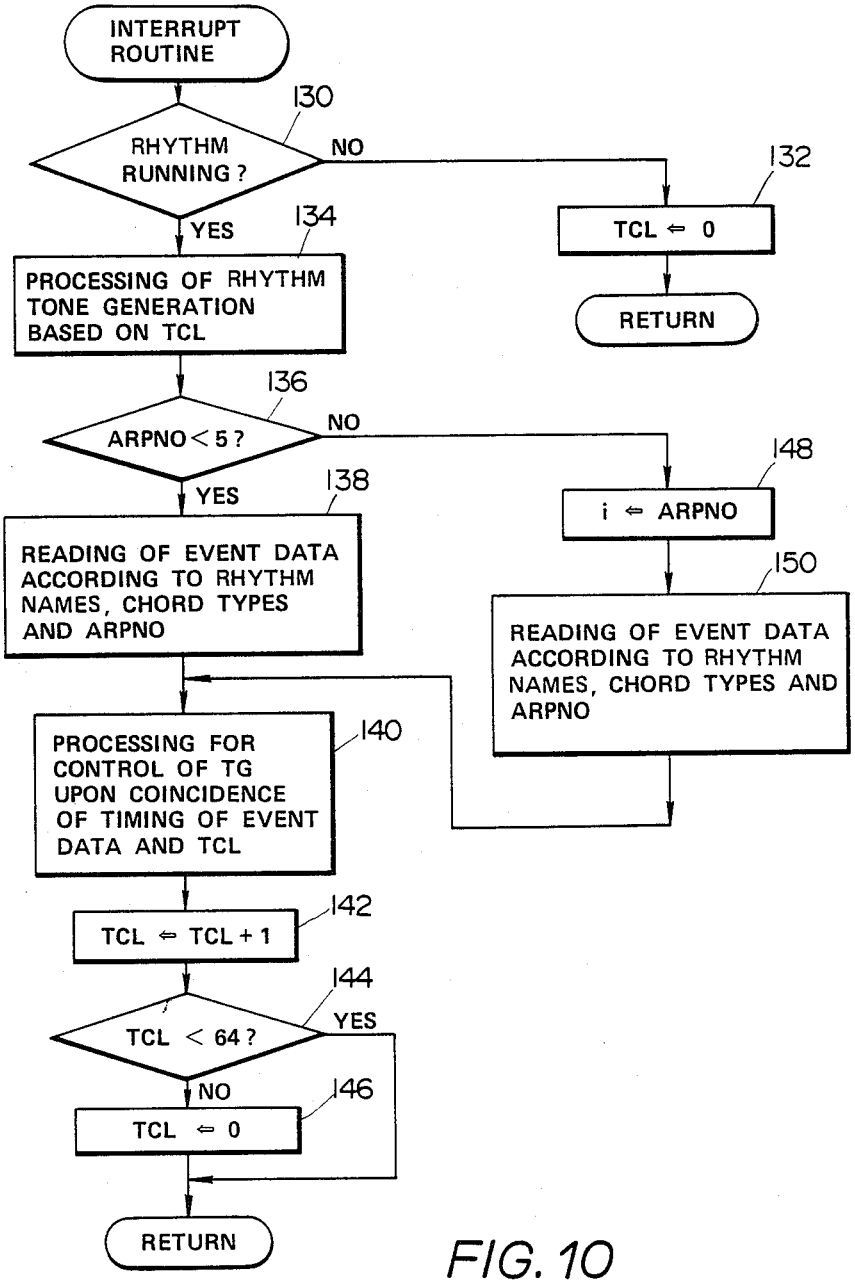
FIG. 10 is a flow chart of a interrupt subroutine.

Interrupt Routine (FIG. 10)

FIG. 10 shows a flow chart of the interrupt routine for auto-rhythm and auto-arpeggio. This routine is executed each time a tempo clock pulse is produced from the tempo clock generator 26.

First, in Step 130, it is determined whether the autorhythm is running, that is, a rhythm start switch is "ON". If the result is "NO", the processing proceeds to Step 132 in which the tempo counter TCL is cleared to zero. Then, the processing returns to the main routine of FIG. 6.

If the result of Step 130 is "YES", the processing proceeds to Step 134 in which the processing for the generation of tone of the rhythm is performed in accordance with the value of the tempo counter TCL. This rhythm tone generation processing will not be described in detail.

Then, in Step 136, it is determined whether the value of the arpeggio chord number register ARPNO is less than 37 5". If the result is "YES", this means that one of the fixedly-assigned chord select switches SW1 to SW4 has been turn on, and the processing proceeds to Step 138.

In Step 138, in accordance with the selected rhythm kind, the detected chord type and the value of the arpeggio chord number register ARPNO, the arpeggio chord pattern to be read from the pattern memory 22 is designated or addressed, and the event data of this arpeggio chord pattern for the three channels are read from the pattern memory 22. The value of the register ARPNO corresponds to the turned-on one of the chord select switches SW1 to SW4. In this case, an address pointer designates which event data are to be read. Then, the processing proceeds to Step 140.

In Step 140, it is determined whether the timing of the read-out even data coincides with the timing of the tempo counter TCL, and if the timing coincidence is detected, the tone generator (TG) 28 is controlled in accordance with its result. More specifically, if the read-out event data represents the production of tone, the tone generator 28 is controlled to produce one or more musical tones based on the pitch difference data of the event data and the detected root note. On the other hand, if the read-out event data represents the stop of tone, out of the musical tones which are being produced, those musical tones corresponding to the pitch difference data of the read-out event data are caused to stop under the control of the tone generator 28. In both case, the value (address data) of the address pointer is changed to enable the reading of the next event data from the pattern memory 22. If the above timing coincidence is not obtained, the above control of the tone generator 28 and the change of the address value are not carried out.

After Step 140, the tempo counter TCL is incremented one in Step 142. Then, the processing proceeds to Step 144 in which it is determined whether the count of the tempo counter TCL is less than 64 (i.e., within one bar or measure). If the result is "YES", the processing returns to the main routine of FIG. 6. On the other hand, if the result of Step 144 is "NO", this means that one bar is ended, and the processing proceeds to Step 146 in which the tempo counter is cleared to zero. Then, the processing returns to the main routine of FIG. 6.

If the result of Step 136 is "NO", this means that one of the assignable chord select switch SW5 to SW8 has been turned on, and the processing proceeds to Step 148 in which a control variable i is made equal to the value of the arpeggio chord number register ARPNO which corresponds to the turned-on switch SW. Then, the processing proceeds to Step 150.

In Step 150, in accordance with the selected rhythm type, the detected chord type and the value (assigned pattern number) of the pattern number register PTNREGi corresponding to the variable i, the arpeggio chord pattern to be read from the pattern memory 22 is designated or addressed, and the event data are read from the pattern memory in a manner as described above for Step 138. Then, the processing returns to Step 140.

Another Embodiment

In the preceding embodiment, the arpeggio chord patterns and the arpeggio chord tone colors can be assigned to the arpeggio chord select switches SW5 to SW8 independently of each other. As another alternative, each of these patterns and each of these tone colors can be assigned in pair to a respective one of the assignable switches SW5 to SW8. In this case, in Step 126 of the tone color processing shown in FIG. 9, the pattern number register PTNREGi is used instead of the tone color number register VCNREGi, and the tone color control data corresponding to the pattern number stored in the pattern number PTNREGi is read from the tone color memory and is fed to the tone generator 28.

Further, in the above embodiments, the pattern memory 22 consists of a ROM but may consist of a random access memory (RAM), in which case the user can store desired accompaniment patterns in the pattern memory.

What is claimed is:

1. A system for selecting accompaniment patterns in accordance with which accompaniment musical tones are produced in an electronic musical instrument, said system comprising:

(a) a memory for storing a plurality of accompaniment patterns;

(b) a plurality of operable members wherein the number of said operable members is less than the number of said accompaniment patterns;

(c) a plurality of storage means corresponding to said operable members, respectively;

(d) select means for selecting one of said accompaniment patterns to produce pattern identification data indicative of the selected accompaniment pattern;

(e) writing means responsive to an operation of any particular one of said operable members for writing said pattern identification data into one of said storage means corresponding to said particular operable member, thereby assigning said selected accompaniment pattern to said particular operable member; and (f) reading means responsive to an operation of said particular operable member for reading from said memory said selected accompaniment pattern.

2. A system according to claim 1, further comprising a second memory for storing a plurality of tone colors, said select means being operable to select a tone color corresponding to the produced pattern identification data, and said reading means being responsive to an operation of said particular operable member for reading from said second memory said selected tone color.

3. A system for selecting accompaniment patterns in accordance with which accompaniment musical tones are produced in an electronic musical instrument, said system comprising:

(a) a first memory for storing a plurality of accompaniment patterns;

(b) a second memory for storing a plurality of tone colors;

(c) a plurality of operable members wherein the number of said operable members is less than the number of said accompaniment patterns;

(d) a plurality of storage means corresponding to said operable members, respectively;

(e) first select means for selecting one of said accompaniment patterns to produce pattern identification data indicative of the selected accompaniment pattern.

(f) first writing means responsive to an operation of any particular one of said operable members for writing said pattern identification data into one of said storage means corresponding to said particular operable member, thereby assigning said selected accompaniment pattern to said particular operable member; and (g) second select means for selecting one of said tone colors to produce tone color identification data indicative of the selected tone color;

(h) second writing means responsive to an operation of any particular one of said operable members for writing said tone color identification data into one of said storage means corresponding to said particular operable member, thereby assigning said selected tone color to said particular operable member;

(i) first reading means responsive to an operation of said particular operable member to which said selected accompaniment pattern has been assigned for reading from said first memory said selected accompaniment pattern; and (j) second reading means responsive to an operation of said particular operable member to which said selected tone color has been assigned for reading from said second memory said selected tone color.

4. A system according to claim 1 or claim 3, in which said plurality of accompaniment patterns are divided into groups of patterns, said groups being represented by respective pairs of chord types and rhythm names.

5. A system according to claim 1, in which said select means comprises a display and select switch means for displaying a name of the selected accompaniment pattern in said display.

6. A system according to claim 3, in which said select means comprises a display and select switch means for displaying at least one of (a) a name of the selected accompaniment pattern and (b) a name of the selected tone color in said display.

* * * * *